United States Patent [19]

Arold et al.

[11] Patent Number: 4,771,942

[45] Date of Patent: Sep. 20, 1988

[54] VEHICLE CROSSFLOW HEAT EXCHANGER

[75] Inventors: Klaus Arold; Gernot Karioth, both of Sindelfingen; Wolfgang Volz, Magstadt, all of Fed. Rep. of Germany

[73] Assignee: Daimer-Benz Aktiengesellschaft, Stuttgart, Fed. Rep. of Germany

[21] Appl. No.: 128,184

[22] Filed: Dec. 3, 1987

[30] Foreign Application Priority Data

Dec. 16, 1986 [DE] Fed. Rep. of Germany ..... 3642911

[51] Int. Cl.[4] ..... F28F 1/10

[52] U.S. Cl. ..... 237/12.3 B; 165/144; 165/41; 165/176

[58] Field of Search ..... 237/12.3 A, 12.3 B, 237/2 A; 165/41, 144, 176, 174, 151

[56] References Cited

U.S. PATENT DOCUMENTS 4,712,608 12/1987 Arold et al. ..... 237/12.3 B X

*Primary Examiner*—Henry A. Bennet

*Attorney, Agent, or Firm*—Barnes & Thornburg

[57] ABSTRACT

In order to bring about, in the case of a crossflow heat exchanger with two heating sections which can be individually regulated through the heat transfer medium, a pipe routing adapted to the particular installation conditions in a motor vehicle, with minimum possible connections, the partition wall subdividing a central deflection header is provided with perforations further dividing both regions of the deviation zone for the heat transfer medium, for a purposeful routing of the heat transfer medium through integrated flow and return tubes from an outer deflection header to the respective opposite heating section. Only one flow pipe is connected to an outer deflection header and the two return pipes lead away from the same outer deflection header mutually separately for the heat transfer medium.

8 Claims, 2 Drawing Sheets

VEHICLE CROSSFLOW HEAT EXCHANGER

BACKGROUND AND SUMMARY OF THE INVENTION

The invention relates to a crossflow heat exchanger regulated through the heat transfer medium with two heating sections for individual heating of the left-hand and right-hand halves of the passenger compartment in a motor vehicle, comprising outer deflection headers and a central deflection header subdivided by a partition wall into a left-hand and a right-hand region and with bottom inflow pipe and top return pipes connected to the deflection headers.

A heat exchanger of this type with mirror image construction of the heating zones and of the connections, wherein each outer deflection header is connected to an inflow pipe and a return pipe, is described in German Published Unexamined Patent Application (DE-OS) 2,025,207. Since the inflow and return pipes have to be connected to the cooling water circuit of the internal-combustion engine, and an accumulation of auxiliaries and supply lines occurs in the pipe passage region, a pipe routing which is difficult to assemble and complicated is obtained due to the prescribed pipe outlets.

It is an object of the invention, while retaining an easily regulated zonal division of the compact heat exchanger, to effect a reduction of the connections, and simultaneously to achieve a position of the connections, which is adaptable to the individual circumstances and optimized as regards simple pipe routing.

This object is achieved by extending an inflow pipe through an aperture in the central header partition wall to the outer deflection header of the opposite side and extending return flow pipes through aperture means in the central header partition wall from the outer deflection header opposite the return flow outlet.

In a preferred exemplary embodiment of the invention the inflow pipe and the return pipes are connected to the same outer deflection header, so that the other outer deflection header is free of connections.

A division of the stream of heat transfer medium in the outer deflection chamber accommodating the inflow pipe is achieved in certain preferred embodiments by having the inflow tube lead away from an outer tube plate and end in the region of the central deflection header adjacent to the perforation.

In order that both heating sections or surfaces exhibit equal heating power for an equal valve position, the deflection header which accommodates the inflow pipe is provided with a guide device which may be constructed as a shutter or upwardly projecting web, according to certain preferred embodiments of the invention.

In another exemplary embodiment of the invention, the inflow pipe merges directly into a flow tube and the latter ends in the region of the deflection header adjacent to the perforation, so that the division of the heat exchanger stream occurs in the centrally located deflection header. In order to achieve equal power conditions in both heating sections even in this case, the flow tube is provided with at least one aperture of predetermined width, through which a passage of heat transfer medium occurs to the region of the central deflection header located in front of the perforation.

Other objects, advantages and oval features of the present invention will become apparent from the following detailed description of the invention when considered in conjunction with the accompanying drawings.

DETAILED DESCRIPTION OF THE DRAWINGS

Figure 1:
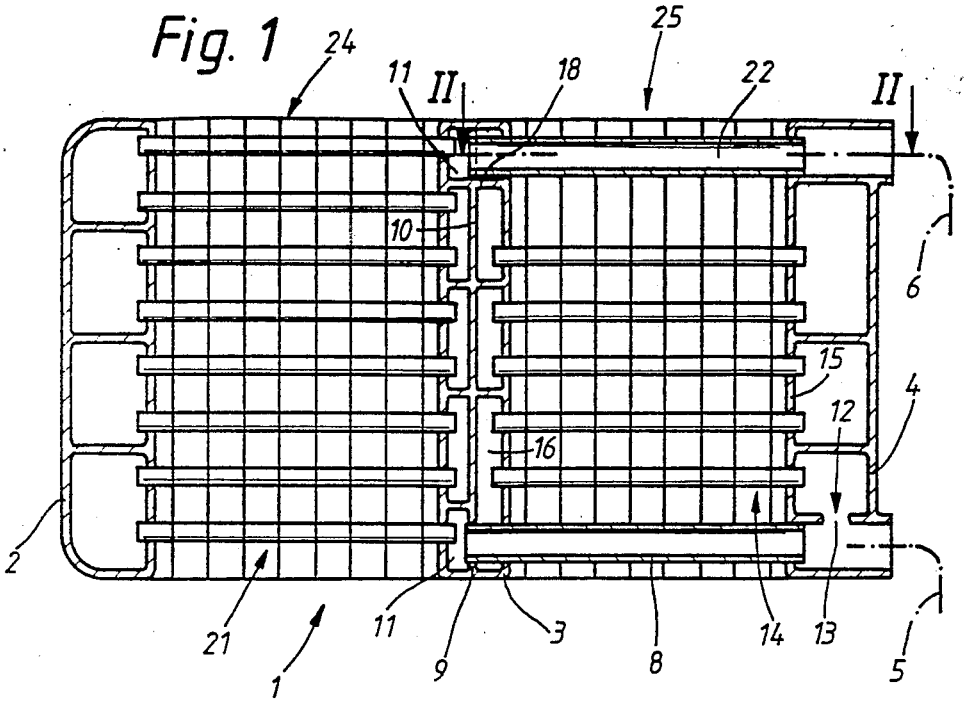
FIG. 1 is a schematic sectional view which shows a crossflow heat exchanger with inflow and return pipes connected to a deflection chamber, constructed in accordance with a preferred embodiment of the invention.
Figure 2:
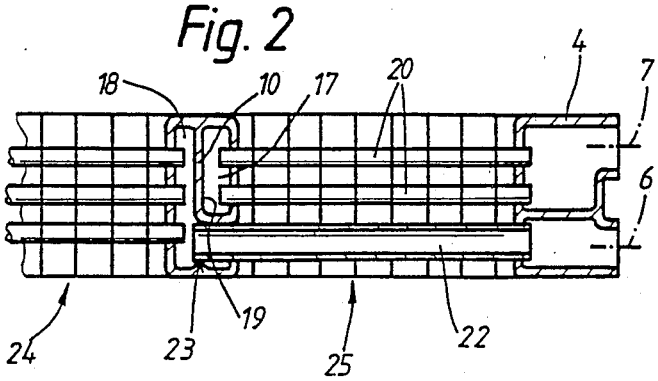
FIG. 2 is a sectional view taken along the line II—II in FIG. 1.

The crossflow heat exchanger 1 illustrated in FIGS. 1 and 2 exhibits a left-hand deflection header 2, a central deflection header 3 and a right-hand deflection header 4, the latter being connected to a bottom central inflow pipe 5. At the top of the right-hand deflection header 4, as may be seen particularly from FIG. 2, two indicated return pipes 6 and 7 lead away, which are mutually separate for the water or other heat exchange medium. In a manner not shown, a volume regulator device, in the form of a phase valve, for example, is arranged in each return pipe 6 and 7.

The stream of heat transfer medium which enters through the inflow pipe 5 into the deflection header 4 according to FIG. 1 is divided in volume into halves as far as possible, while one part passes through a flow tube 8 which leads away from the deflection header 4 and through a perforation 9 in a partition wall 10 subdividing the deflection header 3 into the left-hand region 11 of the deflection header 3 and another part flows away through a guide device 12 in the form of a shutter 13 towards a first finned tube bank 14, which leads away from an outer tube plate 15. This finned tube bank 14 ends in the right-hand region 16 of the deflection header 3, where a deflection occurs which initiates a return flow to the deflection header 4. This process is repeated in a plurality of times in finned tube banks arranged mutually superposed until the stream of heat transfer medium passes, as FIG. 2 shows, through an aperture 17 a partition 18 aligned approximately at right angles to the partition wall 10 into a shaft 19, from where the topmost tube bank 20 extends to the return pipe 7.

The stream of heat transfer medium passing through the flow pipe 8 into the left-hand region 11 of the deflection header 3 enters a lower finned tube bank 21 and passes to the deflection header 2, from where, through further finned tube banks arranged mutually superposed and by alternative deviation, the stream of heat transfer medium is finally passed to a top section of the left-hand region 11 of the deflection header 3 and there enters a return tube 22 which penetrates a perforation 23 of the partition wall 10 and leads to the return pipe 6.

In this manner two individually regulable heating surfaces or sections 24 and 25 are created, while due to the crossflow heat exchanger 1 occupying an upright or inclined position in conjunction with a following duct guide, not shown, an agreeable temperature stratification with temperature decreasing towards the top can be obtained in a simple manner.

Figure 3:
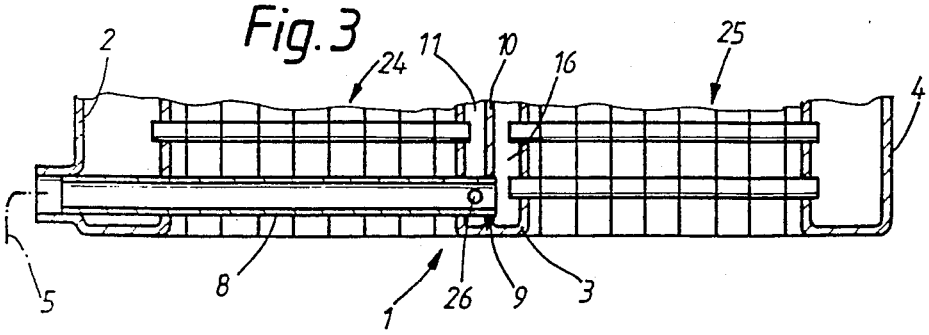
FIG. 3 is a partial schematic sectional view depicting another embodiment with an inflow connection with a flow tube connected directly to it.

In the exemplary embodiment according to FIG. 3, which largely corresponds in this further construction to that according to FIGS. 1 and 2, and in which the same reference numerals are used for similar parts, the distribution of the stream of heat transfer medium arriving through the inflow pipe 5 occurs in the deflection header 3.

For this purpose the flow pipe 5 merges into the flow tube 8, which penetrates the perforation 9 in the partition wall 10 and leads into the right-hand region 16 of the deflection header 3. In order that the left-hand region 11 is also influenced proportionally with warm heat transfer medium, the flow tube 8 is provided at its end with at least one aperture 26.

Figure 4:
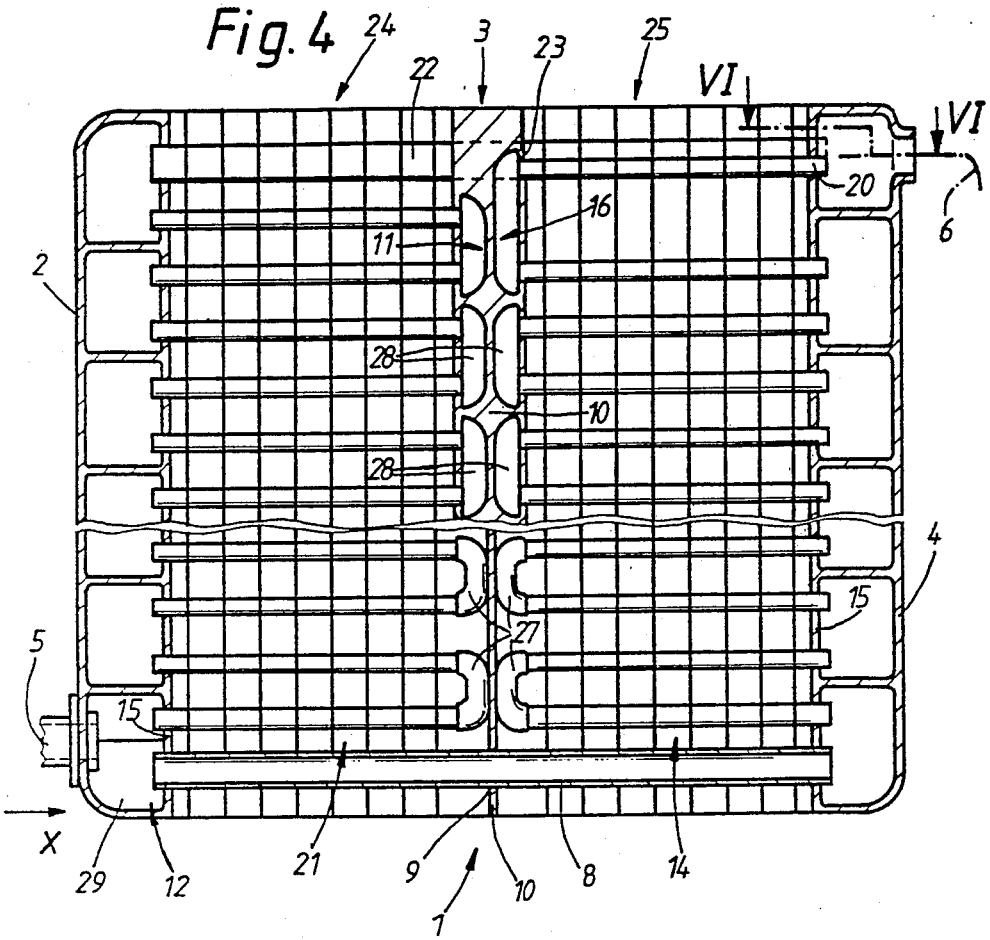
FIG. 4 is a view similar to FIG. 1, which shows a crossflow heat exchanger with flow and return pipes mutually connecting respective deflection chambers constructed in accordance with another embodiment of the invention.
Figure 5:
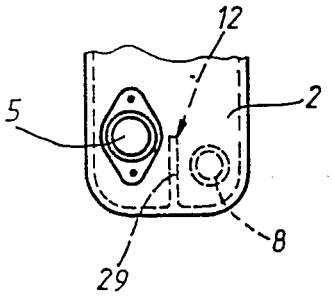
FIG. 5 shows a view in the direction of the arrow X in FIG. 4.
Figure 6:
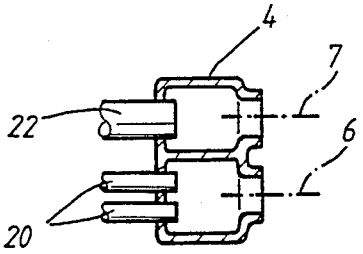
FIG. 6 shows the section taken along the line VI—VI in FIG. 4.

In the variant construction according to FIGS. 4 to 6, in which the same reference numerals are used for similar parts to those of the version according to FIGS. 1 and 2, two possibilities of deviation or deflection with regard to the deflection header 3 are illustrated in FIG. 4. In the lower section the bottom finned tube banks 14 and 21 and the finned tube banks respectively located above them, and also the finned tube banks following in pairs, are mutually connected by tube bends 27 and retained at an interval by the partition wall 10. In the upper section the partition wall 10 is extended to form deflection chambers 28, with each of which a pair of finned tube banks is associated.

The inflow tube pipe 5 leads into the left-hand deflection header 2, in which a web 29 is provided as guide device 12. The flow tube 8 starts from the left-hand tube plate 15, penetrates the central partition wall 10 in the region of the perforation 9 and exits again at the right-hand tube plate 15. The return pipe 22, which penetrates the partition wall 10 in the region of the perforation 23, exhibits the same length dimensions. Depending upon the heat surrender desired, the flow tube 8 and the return tube 22 in all variant constructions may be provided with fins or also be finless. If no heat surrender is desired in a specific section, a tube insulation may be provided.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Crossflow heat exchanger regulated through the heat transfer medium with two heating sections for individual heating of the left-hand and right-hand halves of the passenger compartment in a motor car, comprising outer deflection headers and a central deflection header subdivided by a partition wall into a left-hand and a right-hand region and with a bottom inflow pipe and top return flow pipes connected to the deflection header, wherein:

for a purposeful routing of the heat transfer medium through integrated flow and return tubes from a respective outer deflection header to a respective opposite heating section, the partition wall is provided locally with perforations further dividing both regions of the central deflection header for the heat transfer medium, wherein only one inflow pipe connected to an opposite disposed outer deflection header is provided and two return pipes lead away mutually separately from the respective outer deflection header.

2. Crossflow heat exchanger according to claim 1, wherein the inflow pipe and the return pipes are connected to the same outer deflection header.

3. Crossflow heat exchanger according to claim 1, wherein the inflow tube leads away from an outer tube support plate and ends in a region of the central deflection header adjacent to the perforation.

4. Crossflow heat exchanger according to claim 1, wherein the outer deflection header which accommodates the inflow pipe is provided with a guide device.

5. Crossflow heat exchanger according to claim 4, wherein the guide device is constructed as a shutter.

6. Crossflow heat exchanger according to claim 4, wherein the guide device is formed by an upwardly projecting web.

7. Crossflow heat exchanger according to claim 1, wherein the inflow pipe merges directly into a flow tube and the latter ends in a region of the central deflection header adjacent to the perforation.

8. Crossflow heat exchanger according to claim 7, wherein the flow tube is provided with at least one aperture of predetermined width, through which a passage of heat transfer medium occurs to region of the central deflection header located in front of the perforation.

* * * * *